United States Patent [19]

McMaster

[11] 3,991,931

[45] Nov. 16, 1976

[54] DECORATIVE CONTAINER

[76] Inventor: Marjorie L. McMaster, Van Tassell, Wyo. 82242

[22] Filed: Apr. 6, 1976

[21] Appl. No.: 674,662

[52] U.S. Cl. ..... 229/8; 229/45 R; 93/36 M

[51] Int. Cl.[2] ..... B65D 5/02

[58] Field of Search ..... 229/8, 45; 93/36 M, 93/36 F

[56] References Cited

UNITED STATES PATENTS

| | | | |
|---|---|---|---|
| 1,630,117 | 5/1927 | Faulkner | 229/8 UX |
| 1,682,594 | 8/1928 | Benjamin | 229/8 UX |
| 1,932,368 | 10/1933 | Bowman | 229/8 X |
| 2,116,810 | 5/1938 | Warner | 229/8 |
| 3,044,211 | 7/1962 | Palm | 229/8 X |
| 3,190,532 | 6/1965 | Marsh | 229/8 |
| 3,195,265 | 7/1965 | Marquez et al. | 229/8 X |
| 3,343,297 | 9/1967 | Valentine | 229/8 X |

*Primary Examiner*—Davis T. Moorhead
*Attorney, Agent, or Firm*—Clarence A. O'Brien; Harvey B. Jacobson

[57] ABSTRACT

A decorative container is constructed from a substantially rectangular parallelepiped, such as a recycled cardboard milk carton, by tracing first and second guide lines around three common sides of the carton. The first guide line is disposed substantially parallel to and directly above the bottom of the carton, while the second guide line is spaced toward a peaked top of the carton from the first guide line and includes arcuate portions bowed toward the top of the carton on a parallel pair of the three sides of the carton on which the first and second guide lines are disposed. A third guide line extends along the same pair of parallel sides as the arcuate portions and is substantially parallel to the fourth side of the carton so as to extend between the second guide line and the top of the carton, and includes a flap of the peaked top of the carton which extends from the fourth side so as to form a continuous surface from the bottom of the carton to the peak of the top. Cutting along the guide lines and subsequent bending of the fourth side over the arcuate portions of the second guide line, with the attachment of the fourth side to the adjacent portions of the other three sides of the carton, forms the container, which can then be decorated to become a trinket box, gift box, and the like.

3 Claims, 8 Drawing Figures

DECORATIVE CONTAINER

BACKGROUND OF THE INVENTION

1. Field of the Invention

This invention relates generally to a decorative container, and particularly to a method of making a decorative container from a cardboard carton, and the like, and to a carton suitable for constructing a decorative container.

2. Description of the Prior Art

It is generally known to provide guide lines on a cardboard carton, such as a milk carton, in order to convert the carbon to another object. For example, U.S. Pat. No. 3,190,532, issued June 22, 1965, to O. T. Marsh, discloses a convertible carton provided with guide lines which permit conversion of the carton into a children's toy block.

Further, it is generally known to use pieces of felt, and similar materials, on boxes in order to decorate those boxes in a desired manner. An example of such a use of felt is found in U.S. Pat. No. 1,018,628, issued Feb. 27, 1912, to S. E. Mortenson.

It is also generally known to provide a continuous wall between the top and bottom portions of a hinged container in order to at least partially form the hinge between the portions of the container. One example of such a construction is found in U.S. Pat. No. 2,082,677, issued June 1, 1937, to S. P. Belsinger.

I am aware of the following additional patents that may be pertinent to the invention:

| | | |
|---|---|---|
| 1,037,118 | J. Brewer | Aug. 27, 1912 |
| 1,445,157 | G.W. Noller | Feb. 13, 1923 |
| 2,116,810 | J. Warner | May 10, 1938 |
| 2,338,629 | D. Felder et al. | Jan. 4, 1944 |
| 3,355,088 | L.D. Young | Nov. 28, 1967 |
| 3,401,817 | R.C.J. Palson | Sept. 17, 1968 |

SUMMARY OF THE INVENTION

It is an object of the present invention to provide a method of making a decorative container from a substantially rectangular parallelepiped.

It is another object of the present invention to provide a substantially rectangular parallelepiped having thereon guide lines for use in constructing a decorative container.

These and other objects are achieved according to the present invention by providing a method including: tracing a first line parallel to the bottom of the parallelepiped around three of the side walls thereof, and tracing a second line on the same three side walls and substantially parallel to the first line and spaced toward the top of the parallelepiped from the first line, two parallel side walls of the second guide line having arcuate portions bowed toward the top of the parallelepiped; cutting along the first and second lines and along the fourth side of the parallelepiped to the top portion of the parallelepiped while leaving the fourth side and a top flap of the parallelepiped associated with the fourth side uncut; and bending the fourth side and associated top flap over the arcuate portions and attaching the fourth side and associated flap to the other three sides to form a cover together with the portion of the parallelepiped disposed between the first and second guide lines, the parallelepiped opening at the first guide lines, with the fourth side forming an integral hinge between the cover and bottom portion formed between the bottom of the parallelepiped and the first guide line.

Preferably, the parallelepiped has a peaked top partially formed by the flap associated with the fourth side, with the step of cutting along the fourth side including the step of forming a plurality of tabs along the periphery of the fourth side and the associated flap for facilitating attachment of the fourth side and associated flap to the other three sides of the parallelepiped. In particular, the third guide line should have an irregular, or toothed, configuration in order to form these tabs upon the performance of the cutting step along the third guide line.

Subsequent to the tracing, cutting, and bending and attaching steps in order to form the basic container, the latter is advantageously decorated as by initially stuffing the container with paper, and the like, and spraying paint on the container in order to make the container a desired color. Then, various elements representing straps, tabs, handles, latches, and the like, may be cut from felt, or a similar material, and adhered to the painted container in a conventional manner, such as by the use of a suitable adhesive. Glue drops can be used to represent nail heads, with glitter being sprinkled in the glue drops prior to their drying to add to the aesthetic appeal of the resulting decorative container.

A container provided with first, second, and third guide lines as described above, necessarily forms part of the invention. Whether the container provided with guide lines is provided initially as, for example, a promotional idea by a dairy company, and the like, or whether one initially traces the guide lines on a conventional milk carton, and the like, as an initial step to making a decorative container according to the present invention, the traced guide lines on the container is a necessary part of the invention. Accordingly, a container provided with such guide lines is also provided according to the present invention.

By the phrase "guide lines" and the word "tracing" is meant any markings, indicia, and the like, placed upon the carton by any suitable device or implement, such as a pencil, pen, perforating machine, and the like. Further, the guide lines could be traced on the carton so as to be normally invisible, and only become visible when subjected to chemical treatment, application of heat, or similar chemical and/or physical treatment.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
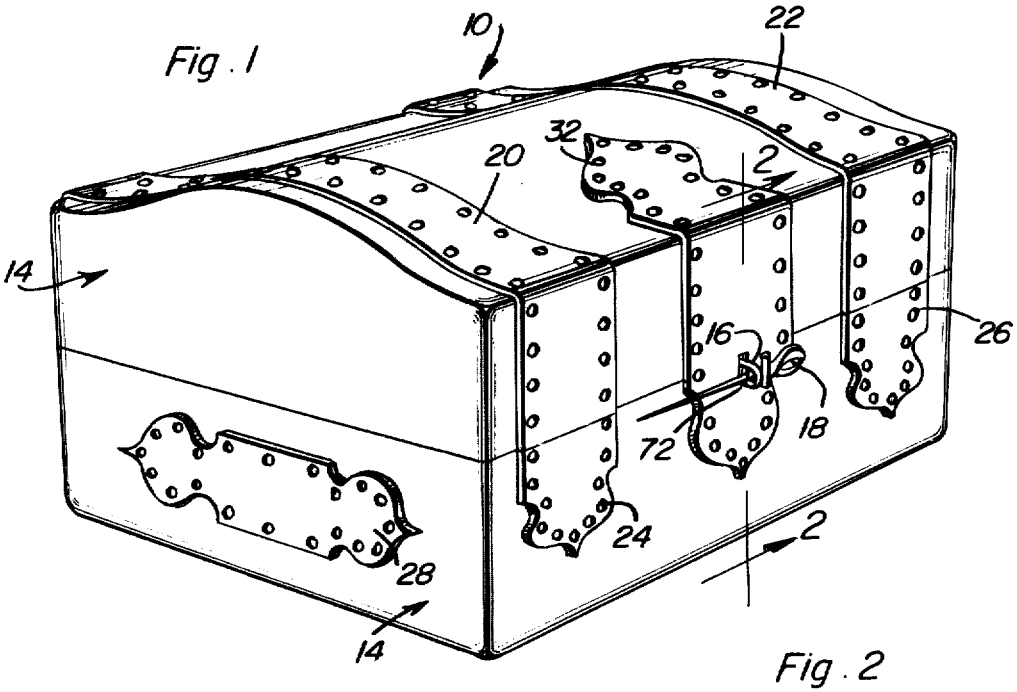
FIG. 1 is a perspective view showing a decorative container constructed according to the present invention.
Figure 2:
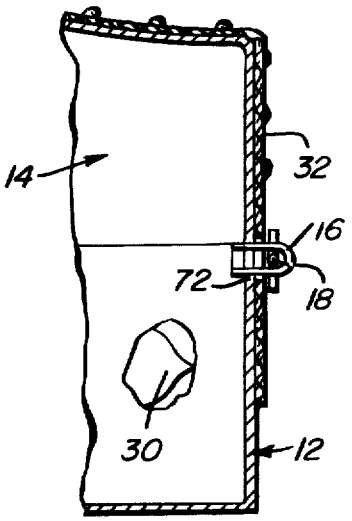
FIG. 2 is a fragmentary, enlarged, sectional view taken generally along the line 2—2 of FIG. 1.

Referring now more particularly to FIGS. 1 and 2 of the drawings, a decorative container 10 constructed according to the present invention, and which may be used as a trinket box, gift box, and the like, includes a bottom portion 12 and a top portion 14 joined toether as by an integral hinge formed by an uncut back wall of container 10. A hasp 16 is advantageously provided, in a manner to be described in greater detail below, which can fit through a slot provided in a suitable latch and receive a, for example, sword toothpick 18 in order to retain container 12 in a closed position as illustrated in FIGS. 1 and 2.

A pair of straps 20 and 22 are advantageously adhered to top portion 14 of container 10 in order to simulate the straps commonly employed on certain trunks, and the like, while a pair of tabs 24 and 26 are adhered to bottom portion 12 in order to mate with straps 20 and 22 when container 10 is in the illustrated closed position and form a continuous ornamental member from the rear of top portion 14 to adjacent the bottom surface of bottom portion 12 of container 10. Further, similar elements may be cut from felt, and the like, and adhered to the sides of bottom portion 12 in order to simulate handles 28 and 30, while a latch 32 is advantageously adhered to top portion 14 in order to extend downwardly over bottom portion 12 and be provided with a slot receiving hasp 16 and permit latching of container 10 in its closed position.

Figure 3:
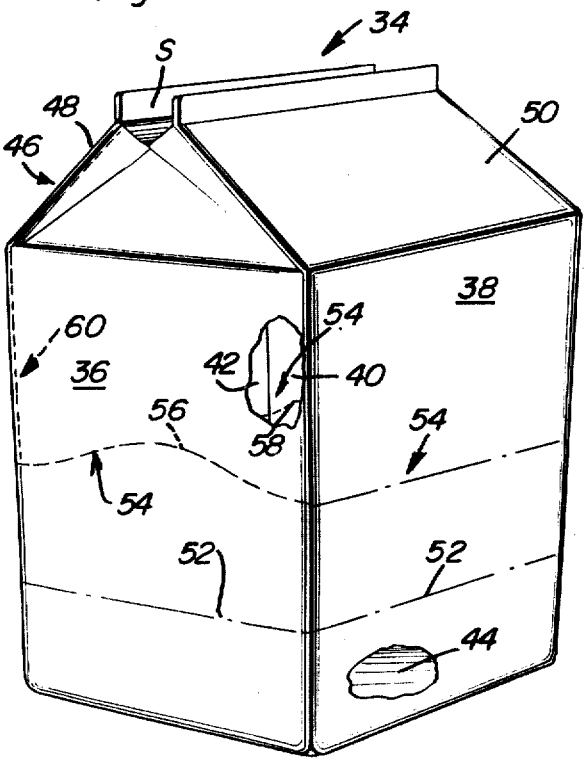
FIG. 3 is a perspective view showing a first step in constructing a decorative container according to the present invention.

Referring now to FIG. 3 of the drawings, a decorative container 10 is constructed from a substantially rectangular parallelepiped 34 which may be a conventional milk or juice carton, and the like, constructed from cardboard or a similar suitable material and including four side walls 36, 38, 40 and 42, a bottom wall 44, and a peaked top 46 including a pair of opposed flaps 48 and 50 which normally are joined together at the peak, or apex, of top 46.

The initial step of constructing a container 10 is to trace on side walls 36, 38, and 40 thereof a first guide line 52 substantially parallel to the plane of the bottom wall 44, and a second guide line 54 on the same three side walls 36, 38, and 40 and substantially parallel to the first guide line 52 and bottom wall 44, except that preferably second guide line 54 includes arcuate portions 56 and 58 on the parallel side walls 36 and 40, with these portions 56, 58 being bowed toward the top 46 of the parallelepiped 34. These arcuate portions 56, 58 will provide the resulting container 10 with a curved top as seen in FIG. 1 in order to enhance the aesthetic appeal of the resulting container.

A third guide line 60 is formed on side walls 36 and 40 and extends into flap 48 of top 46. This flap 48 is that associated with, and integral to, the fourth side wall 42 of parallelepiped 34, and guide line 60 is disposed so as to extend substantially parallel to wall 42 from a juncture with guide line 54 on walls 36 and 40 and to the apex of top 46, and across the top of flap 48 to join with the line extending up the other of the walls 40, 36 and flap 48 to form a continuous guide line between the juncture therewith with the guide line 54. As can be seen from FIG. 3, the carton which constitutes parallelepiped 34 is initially opened along the apex of top 46 in order to facilitate the cutting step.

Figure 4:
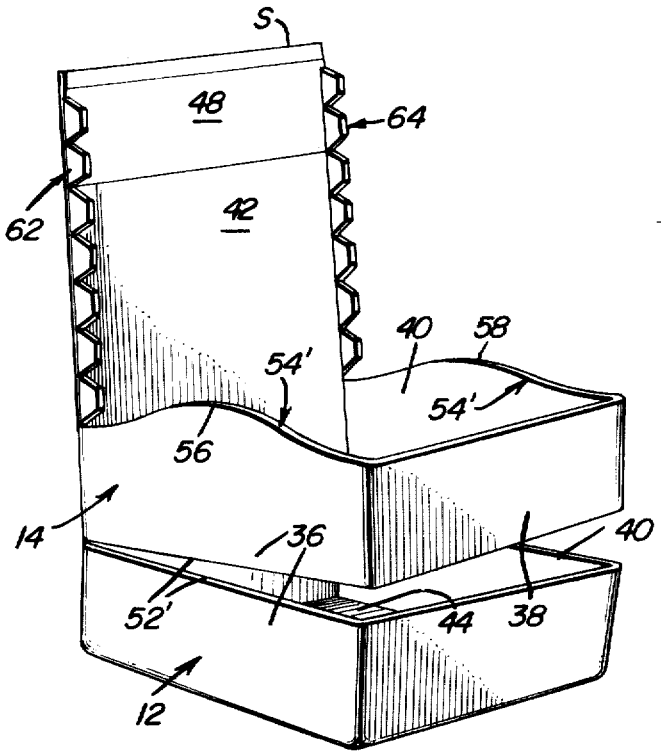
FIG. 4 is a perspective view showing a second step in constructing a decorative container according to the present invention.

Referring now to FIG. 4 of the drawings, cutting is accomplished in a known manner, such as with a pair of scissors, along the guide lines 52, 54, and 60, and the portion of side walls 36, 38, and 40 above the guide line 54 are removed together with their associated portions of the top 46. As can be clearly seen from FIG. 4, tabs 62 and 64 are formed on the peripheral portions of the fourth side wall 42 by retaining portions of the side walls 36 and 40 attached to wall 42. This is advantageously achieved by forming the guide line 60 in a jagged, or toothed, configuration, not shown in FIG. 3, in order to form these tabs 62 and 64 along the peripheral portions of wall 42 and facilitate attachment of wall 42 to the walls 36 and 40, with the portion of flap 46 designated as S in FIGS. 3 and 4 forming yet another tab which facilitates attachment of wall 42 to the wall 38.

Figure 5:
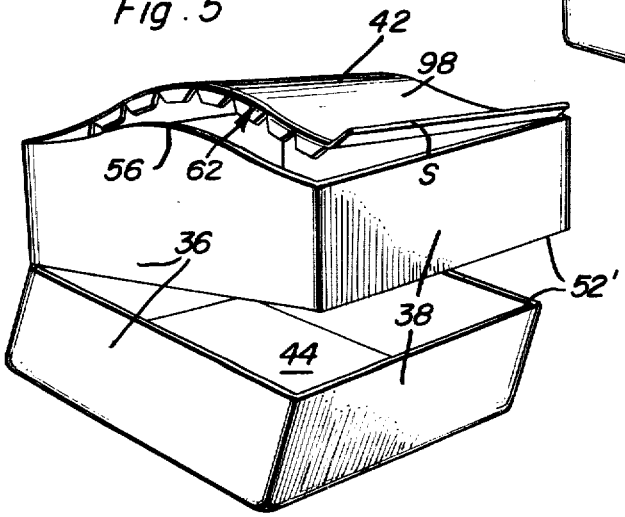
FIG. 5 is a perspective view showing a third step in constructing a decorative container according to the present invention.

As will be appreciated, cutting along the cut lines 52, 54, and 60 will leave fourth wall 42 and its associated flap 48 uncut as shown in FIG. 4 in order to form a continuous piece which may be bent over the top of the container, as shown in FIG. 5 of the drawings. By adhering tabs 62, 64, and S to their associated side walls 36, 40, and 38 with the aid of a suitable adhesive, such as a paste conventionally employed in the cardboard box manufacturing industry, and the like, wall 42 and flap 48 will enclose the top portion of the resulting container 10, with the container 10 opening at the guide line 52 by means of the fourth side wall 42 forming an integral hinge due to having been left uncut.

Figure 7:
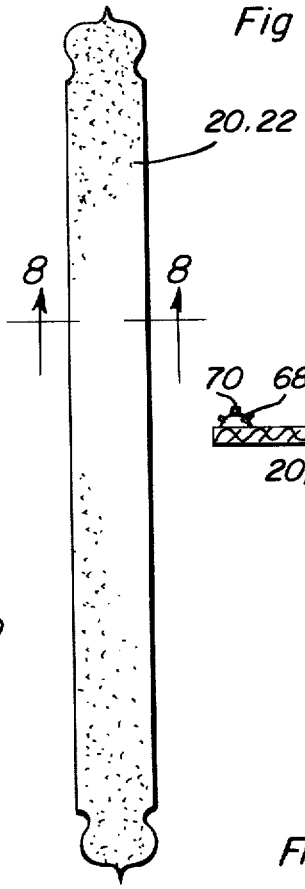
FIG. 7 is a top plan view showing a strap which may be constructed from felt and adhered to a container constructed according to the present invention for decorating the container.
Figure 6:
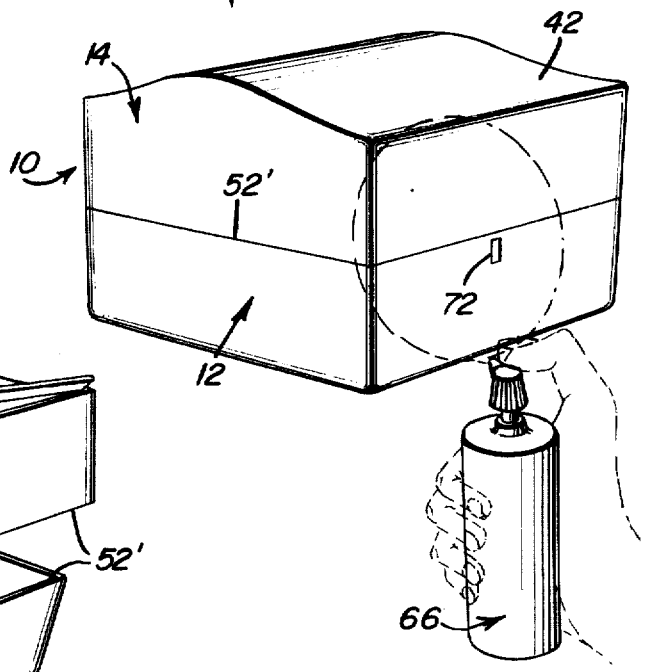
FIG. 6 is a perspective view showing a step in decorating a container constructed according to the present invention.

FIG. 6 of the drawings shows one step in decorating the basic container as by spraying the container with a suitable spray paint. To facilitate the painting operation, the container should be first stuffed with paper, and the like (not shown) so as to prevent the paint from warping or otherwise distorting the box while the paint is drying. As is shown in FIG. 5, the conventional spray paint can 66 can be employed for the painting operation. Subsequently, various elements, such as the strap 20, 22 shown in FIGS. 7 and 8 can be cut in a conventional manner from felt, and the like, and adhered to the various surfaces of the container in order to form the straps 20, 22, tabs 24, 26, handles 28, 30, and latch 32 as described above and shown in FIG. 1.

Figure 8:
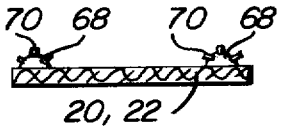
FIG. 8 is an enlarged, sectional view taken generally along the line 8—8 of FIG. 7.

As can best be seen from FIG. 8, glue drops, and the like, 68 may be placed on the felt elements in such a manner as to simulate nail heads, with conventional glitter 70, such as can be purchased at conventional hobby shops, and the like, sprinkled on the glue drops 68 before the latter dry in order to enhance the aesthetic appearance of the finished container 10.

Referring again particularly to FIGS. 1 and 2, a conventional paper clip may be bent in the center portion thereof, as with pliers in a manner not shown, to form a right-angle element, and a slit 72 can be cut in that portion of wall 38 which is in bottom portion 12 of the finished container 10 — that is, the portion of wall 38 that is between the guide line 52 and the bottom wall 44 of the parallelepiped 34 — and a portion of the bent paper clip inserted through the slit 72 to form hasp 16. The clip or hasp 16 may be retained in place as by the use of a suitable adhesive, adhesive tape, and the like in a manner well known but not shown in the drawings.

It will be appreciated from the above description and from the drawings, that while a carton or other suitable parallelepiped provided with the first, second, and third guide lines is necessary to carrying out the invention, the exact location and configuration of the three guide lines may vary somewhat due to varying proportions of cartons employed for making a container in accordance with the present invention. For example, while the specific guide lines 52, 54, and 60 shown in the drawings are suited for use in making a container from a one gallon milk carton, and the like, it may be that for cartons of other proportions it will not be necessary to include the flap 48 as an extension of the back wall, being wall 40 in the illustrated embodiment, to extend over the open top of the container and enclose same. Further, the particular manner of decorating the resulting container may vary to suit various tastes and situations. In particular, those portions of guide line 54 designated 56 and 58 may vary in configuration to provide containers of different over-all form and shape than that illustrated in FIG. 1 of the drawings, while remaining within the scope of the invention which provides for a method of tracing and cutting a carton or other suitable parallelepiped, or a traced carton, and the like, itself, which can be used for making a decorative container.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a carton of substantially rectangular parallelepiped configuration having four side walls, a bottom wall, and a top portion, means for converting the carton to a decorative container, comprising, in combination:

a. a first guide line means for cutting provided on three side walls of the carton and disposed in a plane substantially parallel to the bottom wall of the carton;

b. a second guide line means for cutting provided on the same three side walls of the carton as the first guide line means for cutting and spaced from the first guide line means toward the top portion of the carton; and c. a third guide line means for cutting provided on two parallel side walls of the carton perpendicular to the fourth side wall of the carton and extending from the second guide line means for cutting substantially parallel to the fourth side wall to the top portion of the carton for permitting the fourth side wall above the second guide line means to be folded over the second guide line means upon cutting along the first, second, and third guide line means and be attached to the first, second, and third side walls at the second guide line means, with the first guide line means for cutting forming an opening for the resulting container about the fourth side wall, with the latter acting as an integral hinge.

2. A structure as defined in claim 1, wherein the second guide line means for cutting includes on the same two side walls as the third guide line means for cutting arcuate portions bowed toward the top portion of the carton, with the portions of the second guide line means provided on the other of the three side walls being disposed substantially parallel to the plane of the bottom wall of the carton.

3. A structure as defined in claim 2, wherein the third guide line means for cutting includes an irregular configuration defining a plurality of tabs along the periphery of the fourth side wall of the carton which facilitate attachment of the portion of the fourth side wall of the carton above the second guide line means to the first, second, and third side walls of the carton to form a cover for the resulting container.

* * * * *